US011248500B2

(12) United States Patent
Gaia et al.

(10) Patent No.: US 11,248,500 B2
(45) Date of Patent: Feb. 15, 2022

(54) OPTIMIZED DIRECT EXCHANGE CYCLE

(71) Applicant: TURBODEN S. p. A., Brescia (IT)

(72) Inventors: Mario Gaia, Brescia (IT); Roberto Bini, Brescia (IT); Riccardo Vescovo, Brescia (IT)

(73) Assignee: TURBODEN S.p.A., Brescia (IT)

( * ) Notice: Subject to any disclaimer, the term of this patent is extended or adjusted under 35 U.S.C. 154(b) by 532 days.

(21) Appl. No.: 16/316,024

(22) PCT Filed: Jul. 26, 2017

(86) PCT No.: PCT/IB2017/054522
§ 371 (c)(1),
(2) Date: Jan. 7, 2019

(87) PCT Pub. No.: WO2018/020428
PCT Pub. Date: Feb. 1, 2018

(65) Prior Publication Data

US 2021/0277805 A1 Sep. 9, 2021

(30) Foreign Application Priority Data

Jul. 27, 2016 (IT) ..... 102016000078847

(51) Int. Cl.
*F01K 23/04* (2006.01)
*F01K 3/18* (2006.01)
*F01K 25/08* (2006.01)

(52) U.S. Cl.
CPC ..... *F01K 23/04* (2013.01); *F01K 3/185* (2013.01); *F01K 25/08* (2013.01)

(58) Field of Classification Search
CPC ..... F01K 23/00–18
See application file for complete search history.

(56) References Cited

U.S. PATENT DOCUMENTS 7,942,001 B2 * 5/2011 Radcliff ..... F01K 25/08 60/651
2010/0319346 A1 * 12/2010 Ast ..... F22B 1/1807 60/616

(Continued)

FOREIGN PATENT DOCUMENTS

CN 103206317 A * 7/2013
CN 105019959 A * 11/2015

(Continued)

*Primary Examiner* — Laert Dounis
(74) *Attorney, Agent, or Firm* — R. Ruschena Patent Agent, LLC

(57) ABSTRACT

An organic Rankine cycle system (100, 110, 120) with direct exchange and in cascade comprising a high temperature organic Rankine cycle (10) which carries out the direct heat exchange with a hot source (H) and a low temperature organic Rankine cycle (10') in thermal communication with the high temperature cycle (10). The organic Rankine cycle system (100, 110, 120) is configured in a way that the thermal communication between the cycles (10, 10') takes place through at least one heat exchanger (3) configured to use at least the condensation heat of the high temperature cycle to vaporize and/or preheat the working fluid of the low temperature organic Rankine cycle fluid and through a heat exchanger (4) configured to operate as working fluid sub-cooler for the high temperature organic Rankine cycle (10) and as a working fluid preheater for the low temperature organic Rankine cycle (10').

12 Claims, 5 Drawing Sheets

(56) References Cited

U.S. PATENT DOCUMENTS

| | | | | |
|---|---|---|---|---|
| 2013/0341929 | A1* | 12/2013 | Ho | F22B 27/00 290/54 |
| 2014/0319841 | A1* | 10/2014 | Xu | F01K 25/08 290/54 |

FOREIGN PATENT DOCUMENTS

| | | | | |
|---|---|---|---|---|
| DE | 19907512 | A1 * | 8/2000 | F01K 23/04 |
| EP | 2607635 | A2 * | 6/2013 | F01K 23/04 |
| WO | WO-2011122292 | A1 * | 10/2011 | F01K 27/02 |

* cited by examiner

OPTIMIZED DIRECT EXCHANGE CYCLE

BACKGROUND OF THE INVENTION

1. Field of the Invention

The present invention relates to an organic Rankine cycle (ORC) system with direct exchange and in cascade whose peculiar characteristics allow for high cycle yields.

2. Brief Description of the Prior Art

As is known, a thermodynamic cycle is termed as a finite succession of thermodynamic transformations (such as isotherms, isochores, isobars or adiabatics) at the end of which the system returns to its initial state. In particular, an ideal Rankine cycle is a thermodynamic cycle consisting of two adiabatic and two isobaric transformations, with two phase changes: from liquid to vapor and from vapor to liquid. Its purpose is to transform heat into work. This cycle is generally adopted mainly in power generation plants for the production of electric energy, and uses water as a driving fluid, both in the liquid and vapor form, with the so-called steam turbine.

The application fields of the ORCs are numerous and range from low temperature geothermal systems to systems exchanging heat with combustion fumes at temperatures close to 1000° C. In the latter case, the organic fluid typically does not exchange heat directly with the hot source, but with an intermediate diathermic oil circuit, in order to avoid events of thermo-chemical degradation of the fluid itself. Another typical field of application is the recovery of heat from gaseous flows from industrial processes or from other power generation technologies (for example, gas turbines or as an alternative, internal combustion engines).

More specifically, a direct exchange ORC system provides some advantages with respect to the traditional solution with an intermediate oil circuit, by including a reduction in investment costs due to the absence of the oil circuit and its auxiliary consumptions during operation.

A direct exchange also entails complications in the system with respect to a diathermic oil system, as oil boilers are often standard products or are otherwise designed according to prior art and therefore they are not directly used in the direct exchange configuration for ORC cycles. Furthermore a ORC working fluid is often flammable, and so any fluid leakage from the evaporator could cause fires or burst if the hot source is a gaseous flow with temperatures and oxygen content that will allow such events.

When considering a heat recovery downstream of a gas turbine, possible heat recovery solutions with a direct exchange ORC cycle are multiple. The simplest direct exchange solution is the one with only one ORC cycle, the working fluid of which is preheated, evaporates and eventually overheats by exchanging heat directly with the fumes leaving the gas turbine, as shown by way of example in the graph of FIG. 1. FIG. 1 shows, in a temperature-power diagram, the movements of hot source H, an ORC cycle and a cold source C, as a reference. The working fluid employed is cyclopentane. A high temperature difference can be observed between the hot fumes H and the ORC thermodynamic cycle, which indicates a great exergetic loss affecting the overall performance of the system. The cycle in FIG. 1 has a gross electrical efficiency of 22%, with a gross production of about 8.5 MWel.

There are limits to the possibility of increasing the recovery efficiency, by increasing the difference between the temperature of the hot portion of the cycle and the temperature of the cold portion of the cycle due to the following considerations:

the thermal stability of an organic fluid, which often precludes the use of more elevated temperatures, the characteristics of the fluid itself which limit the possibilities to realize efficient cycles and turbines with too high expansion ratios and/or too low condensing pressures.

Moreover, the great temperature difference between the fumes and the hot portion of the cycle makes the application particularly suitable for the adoption of cascading cycles, i.e. cycles in which the condensation heat of the high temperature cycle is exploited in order to evaporate and preheat the fluid of the low temperature cycle. The possibility of cascading cycles has long been known for many academic articles and patent texts. From the known art it can be seen that the low temperature cycle can receive heat just from the high temperature cycle or partly even directly from the thermal source.

An example is Patent Application EP2607635 which describes a cascading ORC cycle system comprising a high temperature cycle and a low temperature cycle in thermal communication through a condenser/evaporator, in which in the low temperature working cycle the fluid is firstly evaporated and then overheated and in the high temperature working cycle, the fluid is firstly de-overheated and then is condensed. The efficiency gain from the solution with such a cascading cycle is limited by the fact that it is not possible to efficiently cool the fumes. Therefore, the cycles themselves have greater efficiency, which is calculated with respect to the power inputted in the corresponding ORC cycles, but they recover less heat from the hot gases.

Another example is U.S. Pat. No. 7,942,001 B2 which describes a pair of ORC cycles in cascade, in which the organic working fluid of the first cycle is condensed at a temperature above the evaporation temperature of the second working cycle of the organic working fluid. In this case, the fumes can be more cooled in order that they exchange heat even with a cooler fluid (the one of the low temperature cycle) but the recovery system from the hot source is complicated as it has two sections supplied with two different fluids.

Additionally, if the fluid of the high temperature cycle is not flammable, whereas the one of the low temperature cycle is flammable, the safety concerns already described are once again found.

There is therefore a need to define an organic Rankine cycle system with a direct exchange with cascade cycles, without any mentioned drawbacks.

SUMMARY OF THE INVENTION

The object of the present invention is therefore an organic Rankine cycle system with direct exchange and cascade cycles, which can increase the overall efficiency of the system by contacting the hot source with just one of the two fluids used in the cascade cycle, i.e. the fluid of the upper cycle.

According to the present invention, there is therefore described an organic Rankine cycle system with direct exchange and cascade cycles with the features set forth in the attached independent claim.

Further ways of implementing said system, which are preferred and/or particularly advantageous, are described in accordance with the features disclosed in the dependent claims.

BRIEF DESCRIPTION OF THE DRAWINGS

The invention will now be described with reference to the accompanying drawings, which illustrate some examples of non-limiting embodiments, in which.

DETAILED DESCRIPTION OF THE PREFERRED EMBODIMENTS

Figure 1:
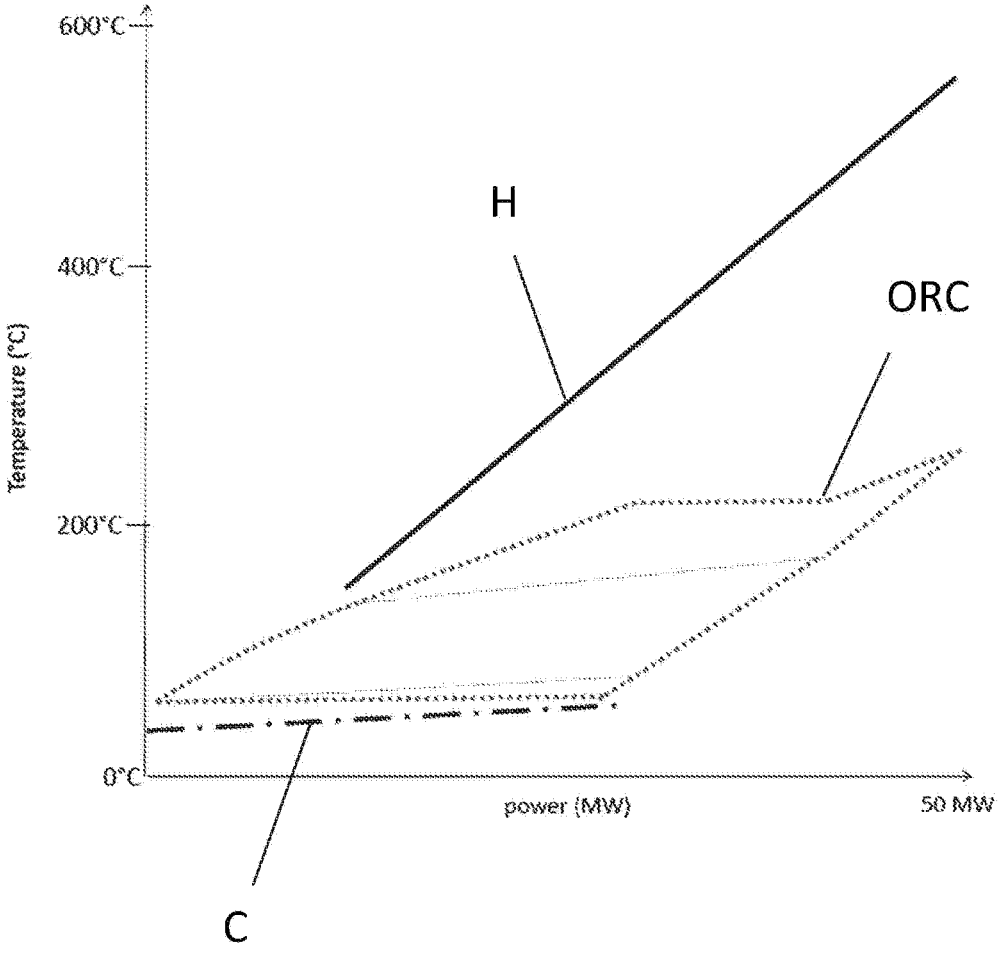
Fig.1 PRIOR ART
FIG. 1 shows a graph of temperature/power of a system according to the prior art.
Figure 2:
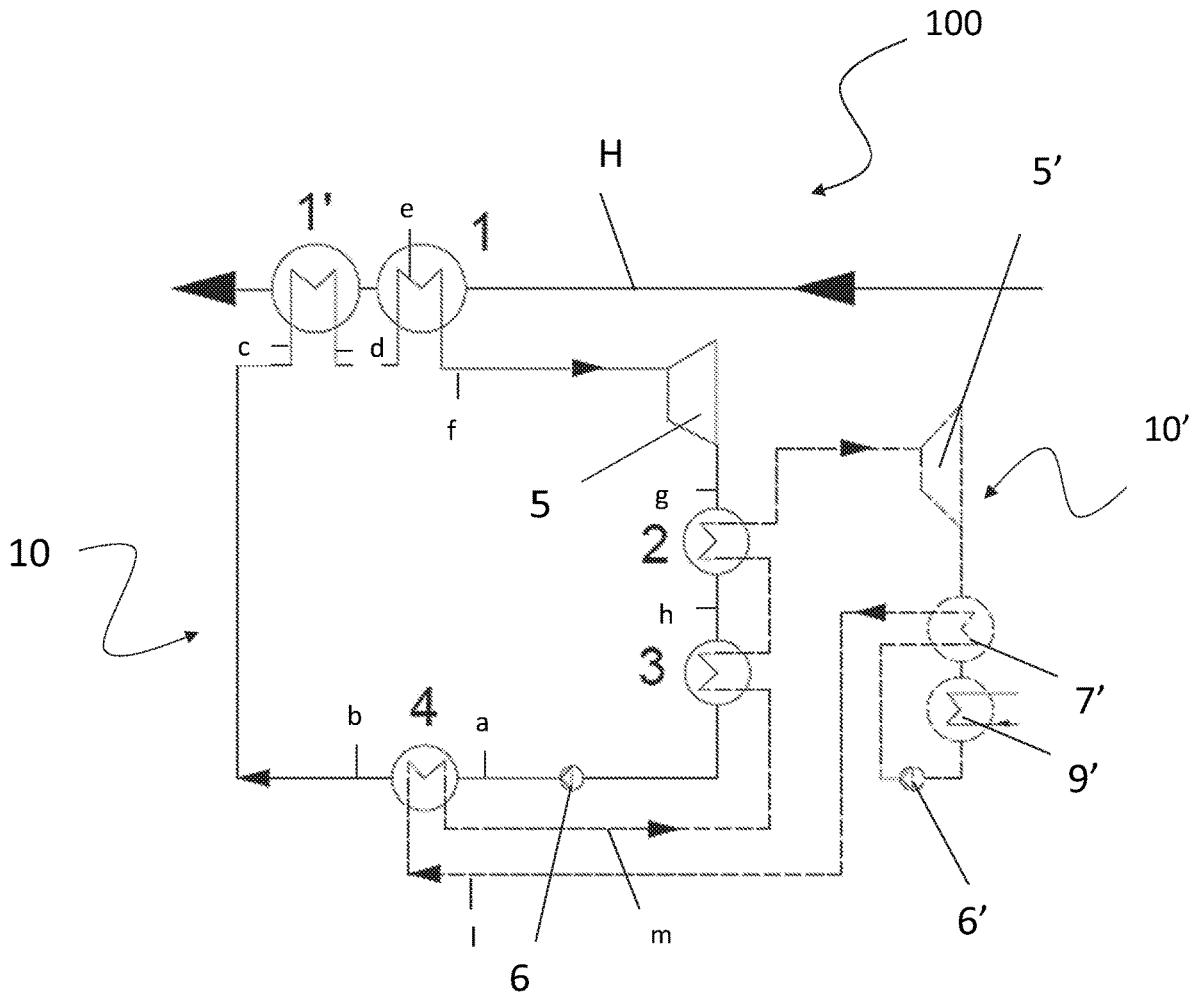
FIG. 2 shows an ORC system scheme for direct exchange and cascade cycles in a first embodiment of the present invention.
Figure 3:
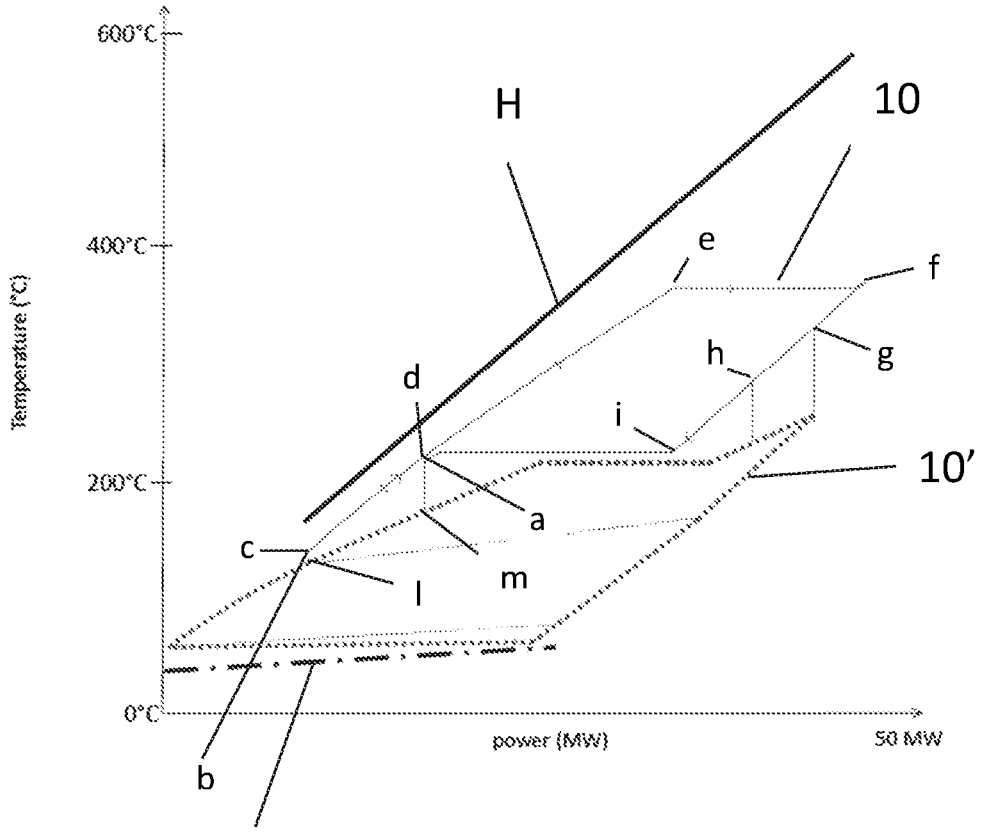
FIG. 3 shows a graph of the temperature/power of the system of FIG. 2.

Referring now to the aforementioned figures, and in particular to FIGS. 2 and 3, an organic Rankine cycle system (ORC) 100 with direct exchange comprises a high temperature cycle 10 (straight lines) and a low temperature cycle 10' (interrupted lines), in mutual thermal communication. Each ORC cycle 10, 10' comprises at least one feed pump 6, 6' for supplying an organic working fluid in a liquid phase, and heat exchangers 1, 1', 2, 3, 4, 7', 9', which depending on the needs and their positioning can act as pre-heaters, vaporizers (possibly overheaters), de-overheaters, condensers or regenerators. At the output of the heat exchangers 1, 2, the vapor of the corresponding working fluids goes thorough an expansion turbine 5, 5' producing the gross work produced by the organic Rankine cycle, which becomes an useful work after having deduced the work absorbed for actuating the auxiliary drives (pumps, fans, hydraulic units, . . . ). Such useful work is a mechanical work collected at the turbine shaft which is generally integrally connected to an electric machine or another user. The working fluid of each ORC cycle finally goes through a condenser which returns it to a liquid phase in order to be sent from the pump 6, 6' again in the circuit.

In the example of FIGS. 2 and 3, the high temperature cycle 10 uses as a working fluid a mixture of diphenyl/diphenyl oxide, whereas the one with a low temperature cycle 10' uses cyclopentane as a working fluid. The diphenyl-diphenyl oxide mixture can be used up to about 400° C. ("bulk temperature") and is commercially known with the trade name Therminol VP-1 or Dowtherm. It can also be vaporized and is therefore suitable for carrying out the high temperature ORC cycle. Other low or high temperature working fluids can be toluene, terphenyl, quadriphenyl, hydrocarbons, siloxanes, alkylated aromatic hydrocarbons, phenylcyclohexane, bicyclohexyl and perfluoropolyethers. Some commercial names include SYLTHERM®, HELISOL®, 5A Therminol® LT, Therminol® VP-3.

With reference to FIG. 2, the working fluid of the high temperature cycle 10 (for example VP-1) is pre-heated, evaporated and possibly overheated in direct contact with the fumes in the heat exchanger 1 (which then makes the functions of a pre-heater, evaporator and possibly overheater)—point f—and then is expanded into the turbine 5. The output steam exiting from the turbine (point g) exchanges heat with a low temperature cycle fluid (for example cyclopentane). VP-1 at this stage is firstly de-overheats the heat exchanger 2 (up to step h) and then condenses into the heat exchanger 3 whereas cyclopentane is preheated and evaporates in the heat exchanger 3 and is overheated in the heat exchanger 2.

Therefore, the heat exchanger 3 takes the function of a low temperature/condenser de-overheater for VP-1 and of a pre-heater and vaporizer for cyclopentane. The heat exchanger 2 instead takes the function of the de-overheater at high temperature for VP-1 and of an overheater for cyclopentane. Obviously, the heat exchangers 2 and 3 can also be made in a single casing and therefore, in fact, they make a single heat exchanger. The low temperature cycle 10' with cyclopentane is further provided with an additional heat exchanger, a regenerator 7 ' in which the cooling of the vapor downstream of the turbine 5' is used in order to preheat the liquid downstream of the pump 6'.

The VP-1 working fluid is then pressurized by a pump 6 and further exchanges heat with cyclopentane in the heat exchanger 4, by cooling from point a to b. In this heat exchanger 4, cyclopentane exiting from the regenerator 7' is preheated from point i to m, so strongly under-cooling the VP1 fluid (preferably by more than 30°, and in FIG. 3 the under-cooling is of about 80° C.). Therefore, the heat exchanger 4 takes the function of an under-cooler for VP-1 and of a pre-heater for cyclopentane. The VP-1 fluid is then heated in the exchanger 1' in contact with the hot fumes, from point c to d.

Constructively, the exchangers 1 and 1' can be integrated into a single vessel or be a single exchanger (for example, a single through counter-flow exchanger in direct contact with the exhaust fumes of a gas turbine).

The low cyclopentane temperature (point c), according to the present invention, effectively cools the hot fumes, for example the fumes of a gas turbine, causing them to be exchanged with a fluid at a much lower temperature than the condensation temperature of the high temperature cycle. An analogous result of the thermal efficiency could have been obtained by cooling the fumes in the exchanger 1' crossed by the low temperature cycle fluid (cyclopentane), but this would not have allowed the advantage described below. In fact, the fumes exchange heat in a direct way only with the VP-1 fluid and not with cyclopentane and this gives an advantage both in terms of simplicity of the exchanger (in case 1' and 1 they are integrated in the same body) as well as in circuits (as to the exchangers 1 and 1' only one working fluid is conveyed) and as the VP1 fluid has more favorable safety features (for example, there is no risk of burst with respect to cyclopentane). This under-cooling phase thus generates a kind of intermediate heat exchange circuit without the need for additional circulation pumps and all the other components present in a closed circuit (for example, in an expansion vessel): the VP-1 fluid firstly is cooled by exchanging heat with cyclopentane (ab), then it warms up in contact with the fumes (cd), and retraces almost the same curve on a temperature-power diagram.

FIG. 3 shows a temperature-power diagram of the transformations of the hot source H in the high temperature cycle 10, the low temperature cycle 10', and the cold source C. From the same figure it can be seen that the VP-1 working fluid under-cooling is made at about 80° C. The FIG. 3 cycle achieves a gross electrical efficiency of 28%, with a gross output power greater than 10 MWel (the high and low temperature sources being the same as in FIG. 2).

The high temperature cycle using a VP-1 working fluid as shown in FIGS. 2 and 3 does not have a regeneration phase (i.e., the cooling of downstream steam of the turbine is not used in order to preheat the liquid downstream of the pump).

The steam of VP-1 fluid exiting from the turbine (point g) generates a vapor-steam exchange with cyclopentane, which is overheated and is cooled up to the point h.

Figure 4:
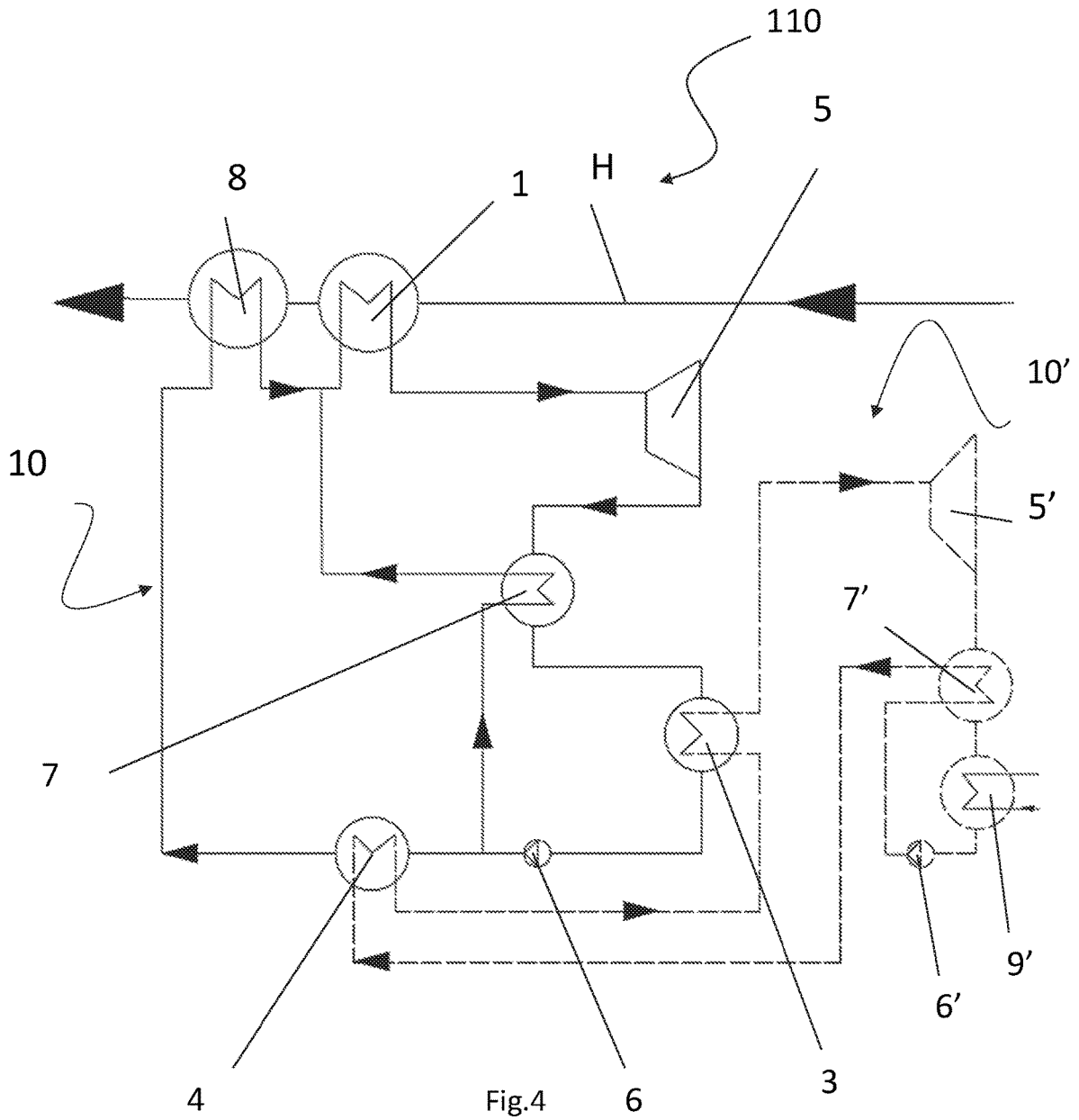
FIG. 4 is a schematic graph of an ORC system for direct exchange and cascade cycles in a second embodiment of the present invention.
Figure 5:
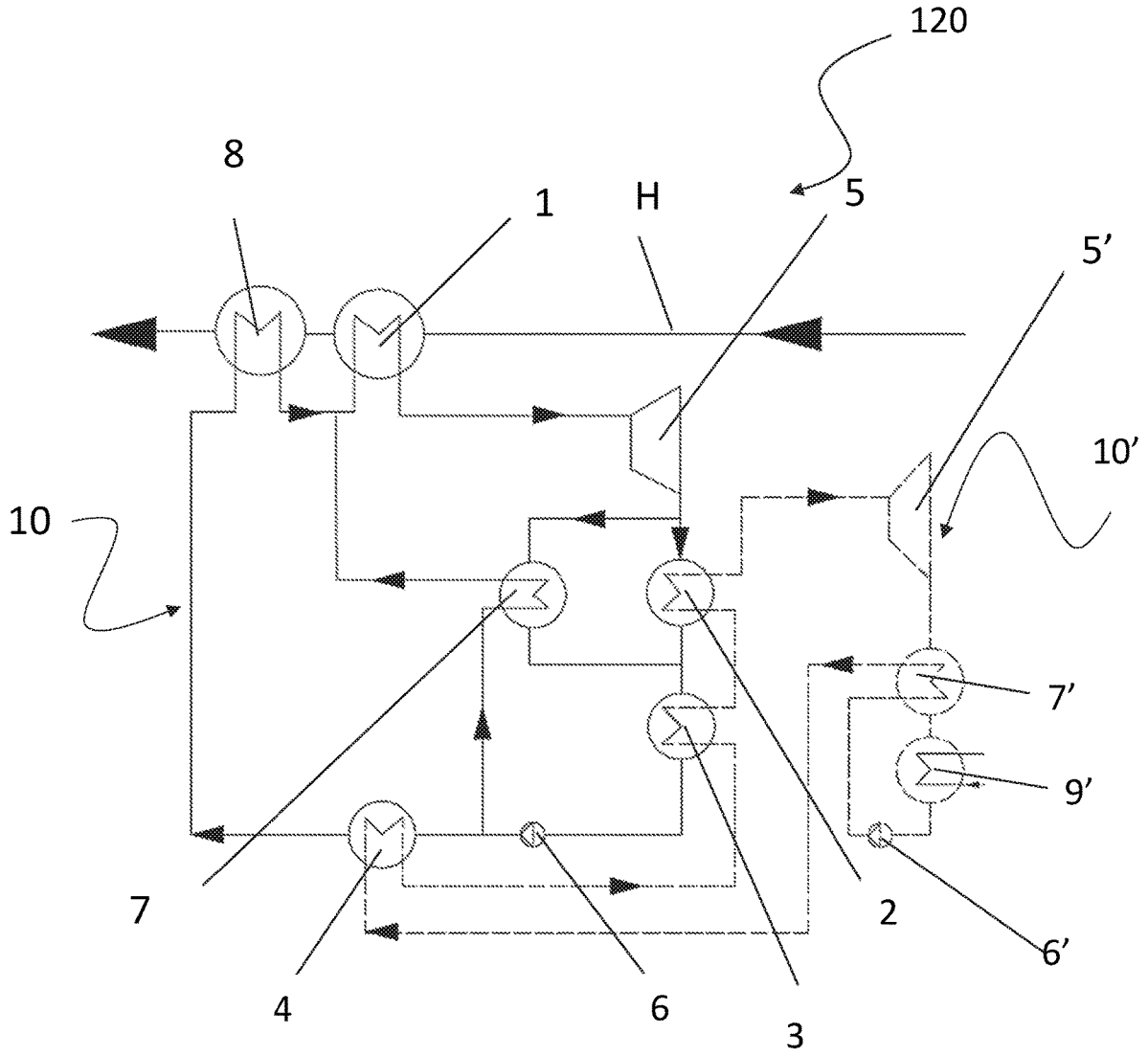
FIG. 5 is a schematic graph of an ORC system with cascade cycles according to a third embodiment of the present invention.

In FIGS. 4 and 5 show two alternate configurations of direct exchange ORC systems and cascade cycles 110, 120 are shown. Compared to the system 100 of FIG. 2, these systems differ due to the fact that a regenerator 7 is also used for the high temperature cycle; the use of a regenerator allows to increase the efficiency of the cycle, at the expense of the thermal power recovered from the hot source H. The liquid VP-1 fluid is divided into two flow, the one directed to the under-cooling phase, and the other to the regenerator 7. The under-cooled flow in the under-cooler 4 is preheated by the hot source in a pre-heater 8 and then is reconnected with the flow coming from the regenerator 7 upstream of the pre-heater-vaporizer 1. As the flow of VP1 in the pre-heater 8 is lower than the case of FIG. 2, the cooling of the fumes and therefore the recovered thermal power will be lower. According to the diagram of FIG. 4, the hot side of the regenerator 7 is supplied with the total steam flowing from the turbine 5. The schematic system 120 shown in FIG. 5 differs from the schematic system 110 of FIG. 4, as the hot side of the regenerator 7 is instead supplied by a portion of the steam flow rate coming from the turbine 5, whereas the remaining portion of the vapor flow rate performs the overheating phase of the low temperature cycle in the over-heater/de-over-heater 2.

Depending on the application, at the design stage a function according to the diagrams in FIG. 2, 4 or 5 can be looked for, in order to maximize the performance of the recovery system.

The system proposed by the present invention is particularly advantageous in the case where the condensation pressure of both cycles is comprised between 50 and 2000 mbar absolute, whereas the high temperature evaporation pressure of the cycle is comprised between 4 and 8 bar and the evaporation pressure of the low temperature cycle is comprised between 20 and 35 bar absolute.

In addition to the embodiments of the invention, as described above, it has to be understood that there are numerous further variants. It must also be understood that said embodiments are only exemplary and do not limit the object of the invention, its applications, or its possible configurations. On the contrary, although the foregoing description makes it possible for a man skilled in the art to implement the present invention at least according to an exemplary configuration thereof, it has to be understood that many variations of the described components are conceivable without thereby escaping from the object of the present invention, as defined in the appended claims, literally and/or according to their legal equivalents.

The invention claimed is:

1. An Organic Rankine cycle system (100, 110, 120) with a direct heat exchange and in cascade comprising:

a high temperature organic Rankine cycle (10) which carries out the direct heat exchange with a hot source (H) and a low temperature organic Rankine cycle (10') in a thermal communication with the high temperature organic Rankine cycle (10), each organic Rankine cycle (10, 10') comprising at least:

one feed pump (6, 6 ') for feeding a working fluid in the liquid phase, at least one heat exchanger (1, 2, 3) with a vaporizer (1, 3) and over-heater (2) function, one expansion turbine (5,5') which expands the working fluid vapor, at least one heat exchanger with a condenser function (3, 9');

and wherein the thermal communication between the cycles (10, 10') takes place through the at least one heat exchanger (3) configured to use at least condensation heat of the high temperature organic Rankine cycle to vaporize and/or preheat the working fluid of the low temperature organic Rankine cycle and through a heat exchanger (4) configured to operate as a working fluid sub-cooler for the high temperature organic Rankine cycle (10) and as a working fluid preheater (8) for the low temperature organic Rankine cycle (10'), so that the working fluid for the high temperature organic Rankine cycle (10) starts the direct exchange with the hot source (H) at a lower temperature than the condensing temperature of the high temperature organic Rankine cycle (10); and wherein said high temperature organic Rankine cycle (10) and the low temperature organic Rankine cycle (10') both feature a condensation pressure, and an evaporation pressure;

and wherein said high temperature organic Rankine cycle (10) further comprises a regenerator (7) and the working fluid of said high temperature organic Rankine cycle (10) in the liquid phase is divided into two flows, one flow directed to the heat exchanger (4) with the function of sub-cooler of the working fluid of the high temperature organic Rankine cycle (10), the other flow directed to the heat regenerator (7) of the high temperature organic Rankine cycle (10), and wherein said regenerator (7) has a hot side.

2. The Organic Rankine cycle system (100, 110, 120) according to claim 1, wherein said sub-cooling of the working fluid of the high temperature organic Rankine cycle (10) is greater than 30° C.

3. The Organic Rankine cycle system (100, 110, 120) according to claim 1, wherein said low temperature organic Rankine cycle (10') is further provided with a regenerator (7') in which vapor cooling downstream of the expansion turbine (5') is used to preheat the liquid downstream of the pump (6').

4. The Organic Rankine cycle system (100, 120) according to claim 1, wherein said thermal communication between the high temperature organic Rankine cycle (10) and the low temperature organic Rankine cycle (10') also takes place through the at least one heat exchanger with an over-heater function (2) in which working fluid of the high temperature organic Rankine cycle (10) is de-superheated, while the working fluid of the low temperature organic Rankine cycle (10') is superheated.

5. The Organic Rankine cycle system (110, 120) according to claim 1, wherein in a preheater (8) of the high temperature organic Rankine cycle (10) the sub-cooled flow in the heat exchanger (4) of the high temperature organic Rankine cycle is preheated by the hot source (H).

6. The Organic Rankine cycle system (110) according to claim 1, wherein the hot side of the regenerator (7) of the high temperature organic Rankine cycle (10) is fed by the entire vapor flow coming from the expansion turbine (5) of the high temperature organic Rankine cycle.

7. The Organic Rankine cycle system (120) according to claim 1, wherein the hot side of the regenerator (7) of the high temperature organic Rankine cycle (10) is fed by a fraction of the vapor flow coming from the expansion turbine (5) while the remaining vapor flow goes through the heat exchanger (2) with a de overheater function of the high temperature organic Rankine cycle (10).

8. The Organic Rankine cycle system (100, 110, 120) according to claim 1, wherein the condensation pressure of the high temperature organic Rankine cycle (10) and of the low temperature organic Rankine cycle (10') is between 50 and 2000 mbar.

9. The Organic Rankine cycle system (100, 110, 120) according to claim 1, wherein the evaporation pressure of the high temperature organic Rankine cycle (10) is comprised between 4 and 8 bar, and the evaporation pressure of the low temperature organic Rankine cycle (10') is between 20 and 35 bar.

10. The Organic Rankine cycle system (100, 110, 120) according to claim 1, wherein said working fluids for the high temperature or low temperature cycles are selected from the group consisting of diphenyl, diphenyl oxide, toluene, terphenyl, quadriphenyl, hydrocarbons, siloxanes, alkylated aromatic hydrocarbons, phenylcyclohexane, bicyclohexyl and perfluoropolyethers.

11. The Organic Rankine cycle system (100, 110, 120) according to claim 1, wherein said working fluid of the high temperature Organic Rankine Cycle (10) is a mixture of diphenyl/diphenyl oxide.

12. The Organic Rankine cycle system (100, 110, 120) according to claim 1, wherein said working fluid of the low temperature organic Rankine cycle (10') is cyclopentane.

* * * * *